US005813534A

United States Patent [19]

Schamante

[11] Patent Number: 5,813,534

[45] Date of Patent: Sep. 29, 1998

[54] PACKAGE FOR AN ARTICLE

[76] Inventor: John A. Schamante, 1206 E. Maple, Troy, Mich. 48083

[21] Appl. No.: 861,770

[22] Filed: May 22, 1997

[51] Int. Cl.[6] ..... B65D 65/00

[52] U.S. Cl. ..... 206/418; 206/484; 206/497

[58] Field of Search ..... 206/418, 419, 206/420, 421, 484, 497, 524.3

[56] References Cited

U.S. PATENT DOCUMENTS

| | | | |
|---|---|---|---|
| 3,949,868 | 4/1976 | Allen | 206/45.34 |
| 4,757,900 | 7/1988 | Misset et al. | 206/497 |
| 4,815,603 | 3/1989 | Harris | 206/497 |
| 5,044,495 | 9/1991 | Wyslotsky | 206/315.9 |
| 5,128,157 | 7/1992 | Ruiz | 206/497 |
| 5,495,937 | 3/1996 | Fraser | 206/45.14 |

*Primary Examiner*—Jacob K. Ackun

*Attorney, Agent, or Firm*—Gifford, Krass, Groh, Sprinkle, Patmore, Anderson & Citkowski, P.C.

[57] ABSTRACT

A package for an article such as a light bulb having an elongated sheet with two spaced ends. A layer of shrink wrap material overlies at least a portion of one side of the sheet and the layer of shrink wrap material is attached to the sheet at spaced intervals therealong. The ends of the sheet are secured to form a loop having an interior side and an exterior side with the shrink wrap layer being attached to the interior side of the loop. With an article placed within the interior side of the loop, upon application of heat to the shrink wrap material, the portions of the shrink wrap material unattached to the sheet at least partially engulf the article to thereby affix the article to the sheet.

6 Claims, 2 Drawing Sheets

PACKAGE FOR AN ARTICLE

BACKGROUND OF THE INVENTION

I. Field of the Invention

The present invention relates generally to packaging.

II. Description of the Prior Art

There are many types of previously known packaging and especially packaging constructed of paperboard. In some of the previously known packaging, the paperboard is formed from a blank into a closed box and the article to be packaged is positioned within the interior of the box. A primary disadvantage of this type of packaging, however, is that the packaging is relatively expensive not only in material cost, but also the manufacturing cost necessary to form the closed top and bottom to the package.

A still further type of previously known package, oftentimes utilized to package light bulbs, comprises a paperboard package having four sides but an open top and an open bottom. The article or light bulb is then positioned within the interior of the package and indentations from the paperboard package are then provided around both the top and bottom of the light bulb in order to secure the light bulb to the package.

This type of previously known package is less expensive than the previously known six sided closed box package, since both the top and bottom of the package are open. A primary disadvantage of this type of package, however, is that the indentations from the paperboard package to suspend the light bulb within the interior of the package may be improperly formed, detached from the package or are not fully deflected into the interior of the package. When this occurs, the article, such as a light bulb, can fall from the package.

SUMMARY OF THE PRESENT INVENTION

The present invention provides a package for small articles, such as light bulbs, which overcomes all of the above-mentioned disadvantages of the previously known devices.

In brief, the package of the present invention comprises an elongated sheet preferably constructed of paperboard and having two ends. Other types of materials, however, can alternatively be used.

A layer of shrink wrap material overlies at least a portion of one side of the sheet and is attached to the sheet at spaced intervals therealong. Any conventional means, such as glue, can be used to attach the shrink wrap material to the sheet.

The ends of the sheet are then secured together to form a loop having an interior side and an exterior side with the shrink wrap material being attached to the interior side of the loop. Preferably the loop includes at least three planar sides although any shape, such as cylindrical, may alternatively be used.

With the article positioned within the interior of the loop, heat is then applied to the shrink wrap material. When the shrink wrap material becomes heated, the portions of the shrink wrap material that are unattached to the sheet at least partially engulf the article in order to affix the article to the sheet.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 3:
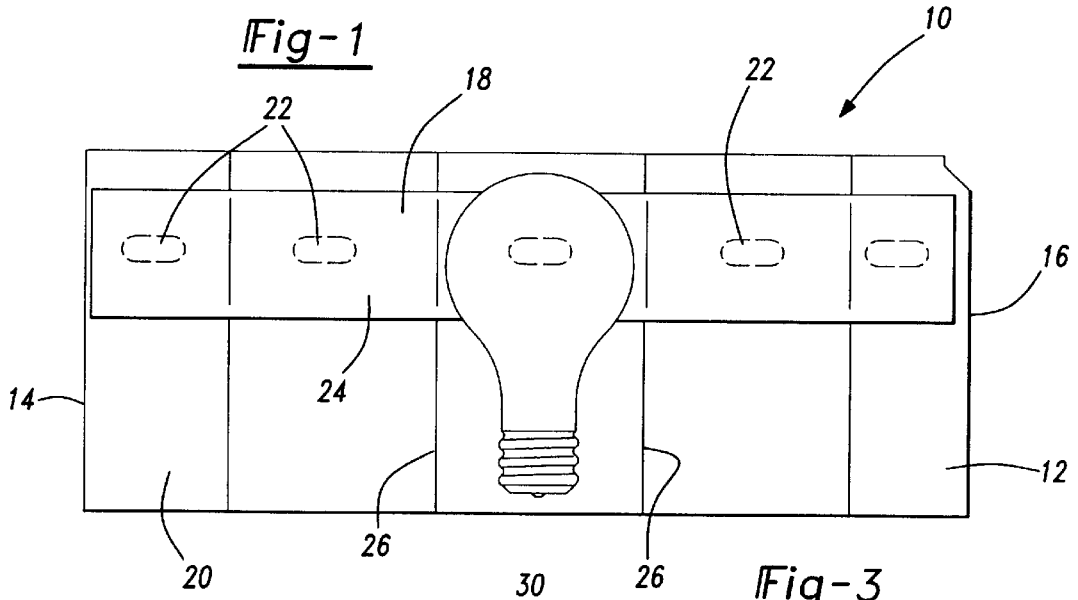
FIG. 3 is a plan view illustrating the preferred embodiment of the present invention in an initial manufacturing step.

With reference first to FIG. 3, a preferred embodiment of the package 10 of the present invention is there shown and comprises an elongated sheet 12 having two ends 14 and 16. The sheet 12 is preferably constructed of paperboard, although any other rigid or semi-rigid material may alternatively be used.

A layer of shrink wrap material 18 overlies at least a portion of one side 20 of the sheet 12. As shown in FIG. 3, the shrink wrap layer 18 extends along the entire length of the sheet 12 but only along a portion of the upper half of the sheet 12.

The shrink wrap layer 18 is secured to the sheet 12 by any conventional means, such as glue 22, at spaced intervals therealong. In doing so, the glue 22 attaches only a portion of the shrink wrap layer 18 to the sheet 12 while leaving other portions 24 unattached to the sheet 12.

Figure 2:
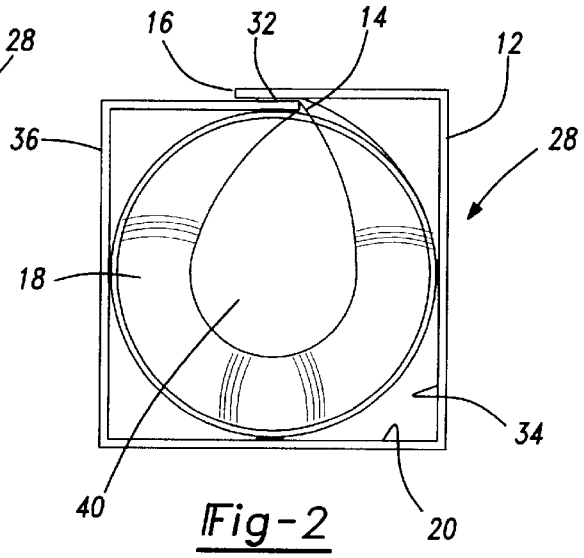
FIG. 2 is a top plan view illustrating a preferred embodiment of the present invention.
Figure 4:
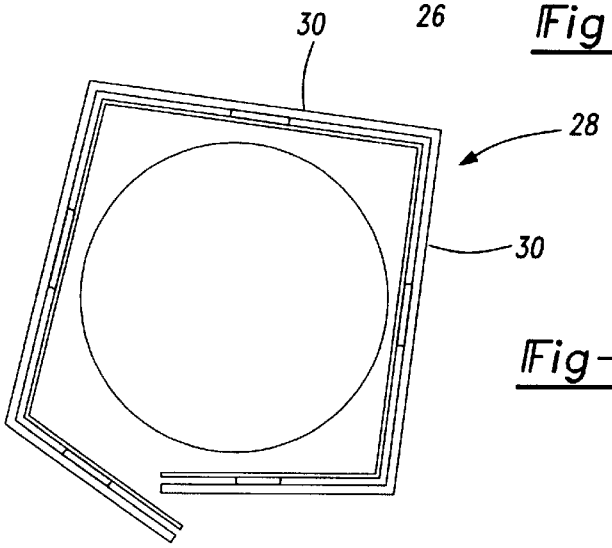
FIG. 4 is a top plan view illustrating the preferred embodiment of the present invention in a still further manufacturing step.

Referring now to FIGS. 2 and 4, the sheet 12 preferably includes a number of transversely extending and longitudinally spaced creases 26. These creases form fold lines which enable the sheet 12 to be folded into a loop 28 as shown in FIGS. 2 and 4. The loop 28 preferably has at least three and preferably four planar sides 30 although any other shape of the loop 28, such as cylindrical, may alternatively be used.

With the loop fully formed as shown in FIG. 2, the ends 14 and 16 of the sheet 12 are secured together by any conventional means, such as a glue layer 32. In doing so, the loop has both an interior side 34 and an exterior side 36 with the shrink wrap layer 18 being positioned on the interior side 34.

Figure 1:
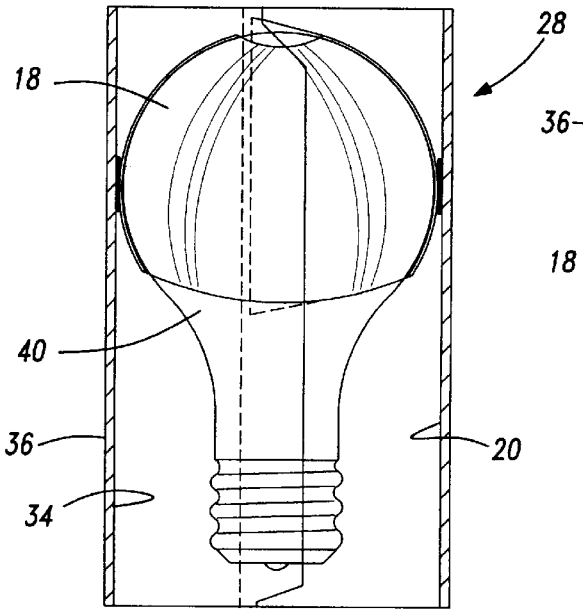
FIG. 1 is a longitudinal sectional view illustrating a preferred embodiment of the present invention.

With reference now to FIGS. 1 and 2, after formation of the loop 28, an article, such as a light bulb 40, is positioned within the interior of the loop 28. Heat is then applied to the shrink wrap layer 18 which causes the shrink wrap layer 18 to at least partially engulf the light bulb 40 thereby affixing the light bulb 40 to the interior side 34 of the loop 28.

With reference now to FIGS. 5*a*–5*f*, the processing steps to create the package of the present invention are there sequentially illustrated. At step 5*a*, the elongated sheet 12 together with its crease lines 26 is first cut by any conventional means, such as by stamping or die cutting.

Figure 5A:
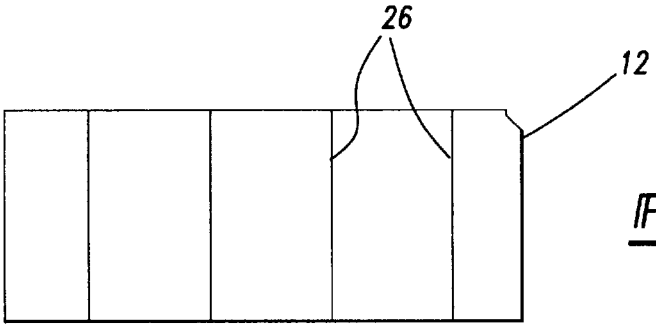
FIGS. 5*a*–5*f* are diagrammatic views illustrating the manufacture of the preferred embodiment of the present invention.
Figure 5B:
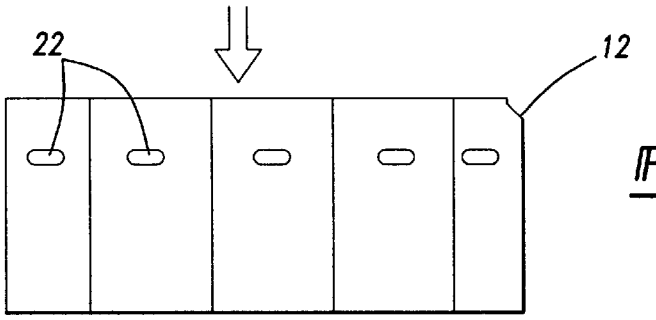
Figure 5C:
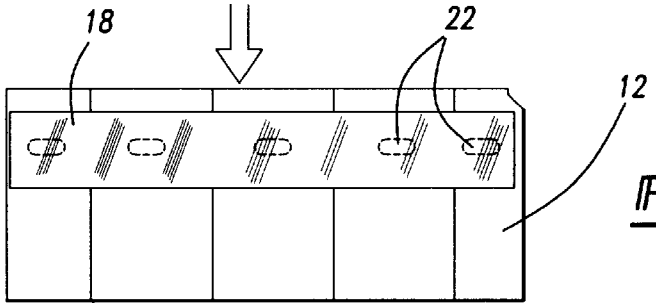

In FIG. 5*b*, the glue 22 is applied at spaced intervals along the sheet 12. The layer 18 of shrink wrap material is then applied along the sheet 12 across the glue as shown in FIG. 5*c*.

Figure 5D:
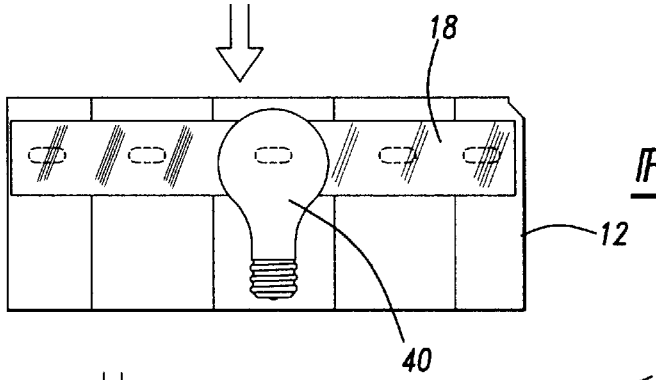
Figure 5E:
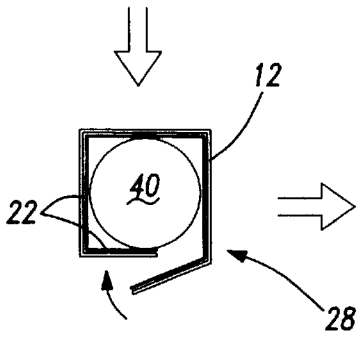

In FIGS. 5*d* and 5*e*, the sheet 12 is formed into a loop illustrated as a four sided box having an open top and an open bottom in FIG. 5*e*. The article, such as the light bulb 40, is positioned within the interior of the formed loop.

Figure 5F:
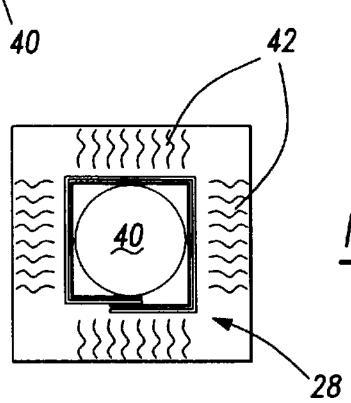

At FIG. 5*f*, heat is applied to the shrink wrap material as illustrated at 42. In doing so, the unattached portions of the shrink wrap material partially engulf the light bulb 40 to secure the light bulb 40 within the interior of the loop 28.

Although the present invention has been described as packaging for a light bulb, it will be understood, of course, that the package of the present invention may be used to package other types of articles.

Having described my invention, however, many modifications thereto will become apparent to those skilled in the art to which it pertains without deviation from the spirit of the invention as defined by the scope of the appended claims.

I claim:

1. A package for an article comprising:

an elongated sheet, said sheet having two spaced ends and a plurality of transverse fold lines which divide the sheet into longitudinally adjacent panels, one panel at one end of said sheet adapted to overlie a further panel at the other end of the sheet to form a loop, a layer of shrink wrap material having a pair of longitudinal edges and overlying at least a portion of one side of said sheet, said layer extending along the entire length of said sheet, means for attaching discrete portions of said shrink wrap material to at least a plurality of said panels, each of said discrete portions disposed centrally with respect to said longitudinal edges of said shrink wrap, means for securing said ends of said sheet together to form said loop having an interior side and an exterior side, said shrink wrap layer being attached to said interior side of loop, wherein with the article positioned within the interior side of said loop, upon application of heat to said shrink wrap material, portions of said shrink wrap material unattached to said sheet at least partially engulf the article to thereby affix the article to said sheet.

2. The invention as defined in claim 1 wherein said sheet comprises a paperboard sheet.

3. The invention as defined in claim 1 wherein said loop comprises at least three substantially planar sides.

4. The invention as defined in claim 1 wherein said loop comprises four substantially planar sides.

5. The invention as defined in claim 2 wherein said attaching means comprises means for attaching portions of said shrink wrap material to at least two of said planar sides.

6. The invention as defined in claim 1 wherein said attaching means comprises glue.

* * * * *